US012594973B2

(12) United States Patent
Rohowski

(10) Patent No.: US 12,594,973 B2
(45) Date of Patent: Apr. 7, 2026

(54) STEP DEVICE FOR A RAIL VEHICLE

(71) Applicant: Siemens Mobility GmbH, Munich (DE)

(72) Inventor: Eric Rohowski, Willich-Anrath (DE)

(73) Assignee: Siemens Mobility GmbH, Munich (DE)

( * ) Notice: Subject to any disclaimer, the term of this patent is extended or adjusted under 35 U.S.C. 154(b) by 542 days.

(21) Appl. No.: 18/043,091

(22) PCT Filed: Aug. 6, 2021

(86) PCT No.: PCT/EP2021/072001
§ 371 (c)(1),
(2) Date: Feb. 27, 2023

(87) PCT Pub. No.: WO2022/043026
PCT Pub. Date: Mar. 3, 2022

(65) Prior Publication Data

US 2023/0303133 A1 Sep. 28, 2023

(30) Foreign Application Priority Data

Aug. 25, 2020 (DE) ..... 10 2020 210 746.7

(51) Int. Cl.
*B61D 23/02* (2006.01)

(52) U.S. Cl.
CPC ..... *B61D 23/025* (2013.01)

(58) Field of Classification Search
CPC .... B61L 15/0081; B61D 23/025; B61D 23/02
See application file for complete search history.

(56) References Cited

U.S. PATENT DOCUMENTS 5,299,904 A * 4/1994 Simon ..... B60R 3/02 414/545
2008/0210020 A1 9/2008 Bieck et al.
(Continued)

FOREIGN PATENT DOCUMENTS

CN 1744070 A 3/2006
CN 111479720 A * 7/2020 ..... B60L 5/205
(Continued)

OTHER PUBLICATIONS

DE_102006022130_A1_espacenet_machine_translation (Year: 2025).*

*Primary Examiner* — Paul N Dickson
*Assistant Examiner* — Maxwell L Meshaka
(74) *Attorney, Agent, or Firm* — Laurence A. Greenberg; Werner H. Stemer; Ralph E. Locher

(57) ABSTRACT

A step device for a rail vehicle includes a step platform, a housing from which the step platform is extendable and retractable again, and a regulating unit for controlling the extension and retraction movement of the step platform. The step platform includes a plurality of step contact segments which, when subjected to pressure, generate signals which are transmitted to the regulating unit. The step contact segments are disposed at predefined distances greater than zero with respect to one another on the step platform in such a manner that an object of predefined minimum contact area with the step platform subjects at least two directly adjacent step contact segments to pressure, and the regulating unit is configured in such a manner that a relevant object is recognized only when signals of two directly adjacent step contact segments are transmitted.

9 Claims, 3 Drawing Sheets

(56) References Cited

U.S. PATENT DOCUMENTS

| | | | | |
|---|---|---|---|---|
| 2011/0304383 | A1 | 12/2011 | Milon et al. | |
| 2023/0303133 | A1 * | 9/2023 | Rohowski | B61L 15/0081 |

FOREIGN PATENT DOCUMENTS

| | | | | | |
|---|---|---|---|---|---|
| DE | 102006022130 | A1 | | 11/2007 | |
| EP | 1464786 | A1 | | 10/2004 | |
| EP | 1715350 | A1 | | 10/2006 | |
| EP | 2015964 | B1 | | 1/2012 | |
| EP | 2996449 | A1 | * | 3/2016 | H05K 7/20672 |
| EP | 3002866 | A1 | * | 4/2016 | H02M 7/487 |
| FR | 2939735 | A1 | * | 6/2010 | B61D 23/025 |
| FR | 3072353 | A1 | * | 4/2019 | B61D 23/02 |
| GB | 2438464 | A | * | 11/2007 | H02M 3/33553 |
| GB | 2535442 | A | * | 8/2016 | B61D 23/02 |
| KR | 20240139281 | A | * | 9/2024 | E01F 1/00 |
| WO | WO-9858148 | A1 | * | 12/1998 | E05F 15/40 |

* cited by examiner

STEP DEVICE FOR A RAIL VEHICLE

FIELD AND BACKGROUND OF THE INVENTION

The invention relates to a step device for a rail vehicle, comprising a step platform, a housing, from which the step platform can be extended and retracted again, and a regulating unit for controlling the extension and retraction movement of the step platform, wherein the step platform comprises a plurality of step contact segments which, when subjected to pressure, generate signals which are transmitted to the regulating unit.

Extendable step platforms, often called sliding steps, are known from the prior art. They have a step switching mat for the detection of weight. This generally consists of two homogenous electrically conductive contact areas which are located one above another and which are potted in a flexible compound. Under step loading, both contact areas have electrical contact with each other (cf. FIG. 1), which is detected and processed by an electronic control unit. Because of the all-over design of the contact areas over the complete step surface of the step platform, it is not possible to distinguish between a step loading by a passenger and a step loading by foreign bodies, such as scatter grit that is clamped in (cf. FIG. 2 and FIG. 3). Clamping of the foreign bodies between the step platform and its housing as the step platform is retracted leads to a detection of a step loading in the electronic control unit and thus also to the stopping of the extension or retraction movement originally envisaged for the protection of the passenger. As a result, the functionality and availability of the step platform is unintentionally reduced.

EP 2 015 964 B1 teaches a step platform having a step contact mat divided up into a plurality of step contact segments. The step contact segments are strip-shaped and are arranged one after another in the direction of movement of the step platform as it is extended or retracted. The control unit is designed in such a way that the signals generated by step contact segments which are located within the housing are ignored or that the step contact segments which are located within the housing are ignored. Thus, malfunctions because of foreign bodies that are clamped in can be avoided. However, the information about the position of the step contact segments is necessary at every time during the extension or retraction movement of the step platform.

SUMMARY OF THE INVENTION

The invention is based on the object of specifying a further simplified step platform.

The object is achieved by the step device described below. Developments and refinements of the invention are identified in the features of the dependent patent claims.

A step device according to the invention for a rail vehicle comprises at least one step platform, an associated housing, from which the step platform is extendable and into which the step platform can be retracted again, and a regulating unit for controlling the extension movement of the step platform and for controlling the retraction movement of the step platform. The step platform that can be extended and retracted again, occasionally also called a sliding step, comprises a plurality of step contact segments which, when subjected to pressure, generate signals which are transmitted to the regulating unit. For this purpose, the step platform can have a step contact mat divided up into a plurality of step contact segments.

The individual step contact segments are at predefined distances greater than zero with respect to one another so that an object with a predefined minimum contact area with the step platform can subject at least two directly adjacent step contact segments to pressure. The step contact segments are arranged on the step platform at a distance from one another.

The regulating unit is designed in such a way that an object on the step platform that is relevant for the control of the extension and/or retraction movement of the step platform is detected and the regulating unit then controls the extension and/or retraction movement, in particular the stopping of the extension and/or in particular the retraction movement of the step platform, only when signals are transmitted from two directly adjacent step contact segments.

Alternatively, the step platform, in particular the step contact mat of the step platform, is designed in such a way that a signal representing an object on the step platform that is relevant for the control of the extension and/or retraction movement of the step platform is generated and transmitted to the regulating unit and the regulating unit then controls the extension and/or retraction movement, in particular effects the stopping of the extension and/or in particular the retraction movement of the step platform, only when the object on the step platform subjects two directly adjacent step contact segments to pressure.

In the first case, each step contact segment that is subjected to pressure generates a signal which is input into the regulating unit. The latter detects an object on the step platform that is relevant for the control of the extension and/or retraction movement of the step platform only when the signals from two directly adjacent step contact segments have been input. In the second case, on the other hand, a signal which represents an object that is relevant for the control of the extension and/or retraction movement of the step platform and which is input into the regulating unit is generated only when two directly adjacent step contact segments are subjected to pressure.

It is the same in both cases: only when an object touches two directly adjacent step contact segments and applies a predefined pressure of greater than zero is a stoppage of the retraction movement of the step platform effected by the regulating unit. The regulating unit can then bring about an extension movement.

According to a development of the invention, the step contact segments are strip-shaped and, lying beside one another, are arranged parallel to the direction of the extension and retraction movement of the step platform.

In addition to a strip shape, the step contact segments can assume further flat, geometric figures; for example be designed to be circular or square.

Developed further, they are arranged to be distributed, in particular uniformly, over the area of the step platform.

Thus, the step platform could have circular or square step contact segments distributed regularly over its area.

Developed further, non-sensitive regions are arranged between the step contact segments, wherein the areas of the step contact segments are small in comparison with the areas of the non-sensitive regions between them.

If the step contact segments are designed to be strip-shaped, for example, then the non-sensitive regions between the step contact segments are also strip-shaped. The step contact segments are then correspondingly small in comparison with the non-sensitive regions.

According to a further development of the solution according to the invention, the step contact segments are at equal distances from one another. Thus, the distances between two directly adjacent step contact segments are always the same.

A further development consists in each predefined distance greater than zero between two directly adjacent step contact segments being at most 20 mm, in particular at most 15 mm, so that an object with a circular minimum contact area relative to the step platform having a diameter of 40 mm touches and can apply pressure to at least two directly adjacent step contact segments.

Conversely, the step contact segments are at a distance of at least 10 mm, in particular at least 15 mm, relative to one another, in order to be able to detect smaller objects as not relevant.

In addition, the width of the step contact segments in the direction of the distance to the directly adjacent step contact segment, in particular perpendicular to the direction of the retraction and extension movement of the step platform, can, further developed, be less than 10 mm, in particular less than 5 mm. Developed further, the width of the step contact segments at each point is at least 1 mm, in particular at least 5 mm.

Developed further, the width b of the area of the step contact segments in the direction of the distance to the directly adjacent step contact segment is a function of the distance u to the directly adjacent step contact segment: $b=u*c$, where c is a constant less than 1, in particular less than 0.5, in particular less than 0.3, for example 0.1.

The distance of the step contact segments to one another corresponds to the width of the non-sensitive regions between them. Thus, the width b of the area of the step contact segments is predefined depending on the width u of the non-sensitive region between the corresponding step contact segments.

According to one embodiment, all the step contact segments have the same shape and size and the same distance from one another. Likewise, the non-sensitive regions between them can have the same shape and size.

According to a further development, the step contact segments are designed in such a way that they generate signals which are transmitted to the regulating unit only when subjected to a predefined minimum pressure. In order to cause the signal-triggering pressure on two directly adjacent step contact segments, the object must have a predefined minimum weight.

A further development of the invention provides for the step contact segments to have distances from one another in the direction of and transversely to the direction of the retraction and extension movement of the step platform with non-sensitive regions between them, wherein the object with a predefined minimum contact area with the step platform can apply pressure to a first step contact segment and at least one second step contact segment arranged directly adjacent to the first step contact segment and at a distance transversely to the direction of the retraction and extension movement of the step platform, and at least one third step contact segment arranged directly adjacent to the first step contact segment and at a distance to the first step contact segment in the direction of the retraction and extension movement of the step platform. The step platform is then designed in such a way that a signal representing the relevant object with a predefined minimum contact area with the step platform is generated and transmitted to the regulating unit only when the object on the step platform applies pressure to the first step contact segment and the second step contact segment and the third step contact segment. Alternatively, each step contact segment which is subjected to pressure generates a signal, and the regulating unit is designed in such a way that the relevant object with a predefined minimum contact area is detected only when signals are transmitted from the first step contact segment and from the second step contact segment and from the third step contact segment to the regulating unit.

A vehicle according to the invention, in particular for passenger transportation, in particular a rail vehicle, has at least one step device according to the invention.

The invention permits numerous embodiments. It will be explained in more detail by using the following figures, in each of which an exemplary configuration is illustrated. The same elements in the figures are provided with the same designations.

DETAILED DESCRIPTION OF THE INVENTION

Figure 1:
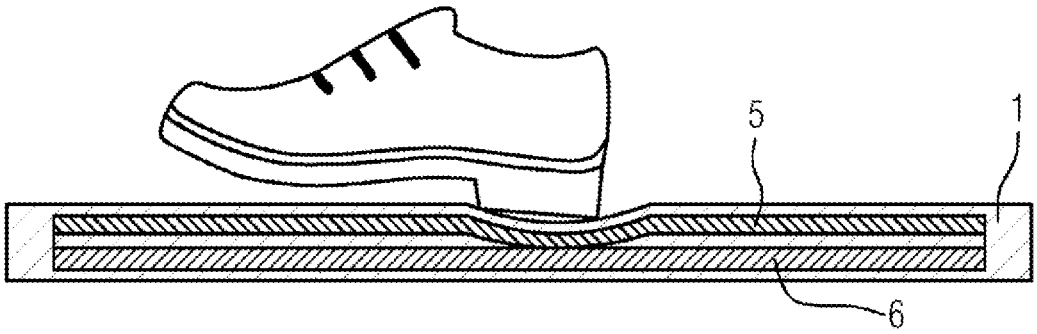
FIG 1 Prior art
FIG. 1 shows a cross section through a step platform having a step contact mat from the prior art.
Figure 2:
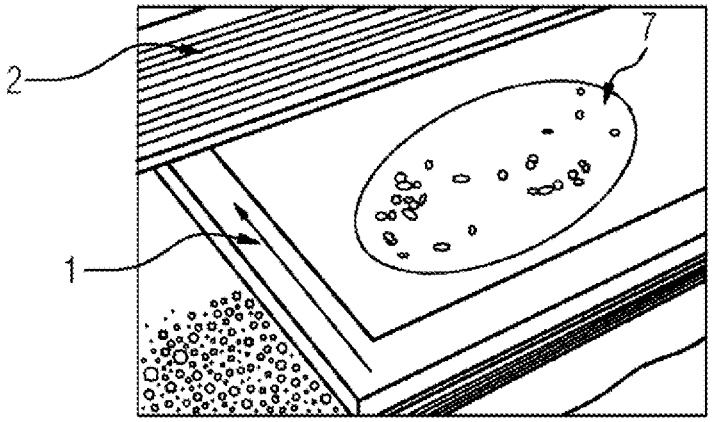
FIG 2 Prior art
FIG. 2 shows a step device with small objects on its step platform.
Figure 3:
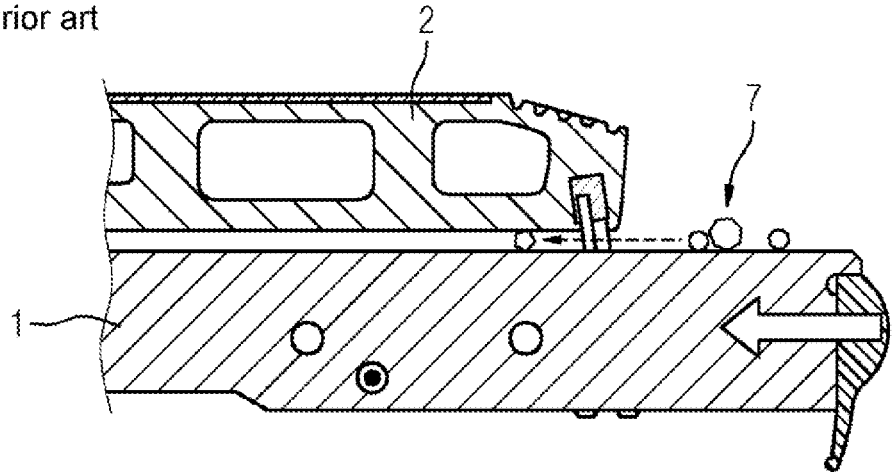
FIG 3 Prior art
FIG. 3 shows a cross section through the step device according to FIG. 2.

A conventional extendable step platform 1 having a step switching mat for the detection of weight is illustrated in FIG. 1. The mat has two homogenous and electrically conductive contact surfaces 5, 6 which lie above one another and which have electric contact with each other under a step loading, whereupon a signal is generated and is transmitted to a regulating unit for controlling the extension and retraction movement of the step platform 1. Because of the all-over design of the contact areas over the complete step area of the step platform 1, it is, however, not possible to distinguish between a step loading by a passenger and a step loading by foreign bodies, such as scatter grit 7 that is clamped in, as illustrated in FIG. 2 and FIG. 3. Clamping of the scatter grit 7 between the step platform 1 and its housing 2 as the step platform 1 is retracted leads to a detection of a step loading in the electronic regulating unit and thus also to the stopping of the extension or retraction movement originally envisaged for the protection of the passenger. The retraction direction is identified by an arrow.

Figure 4:
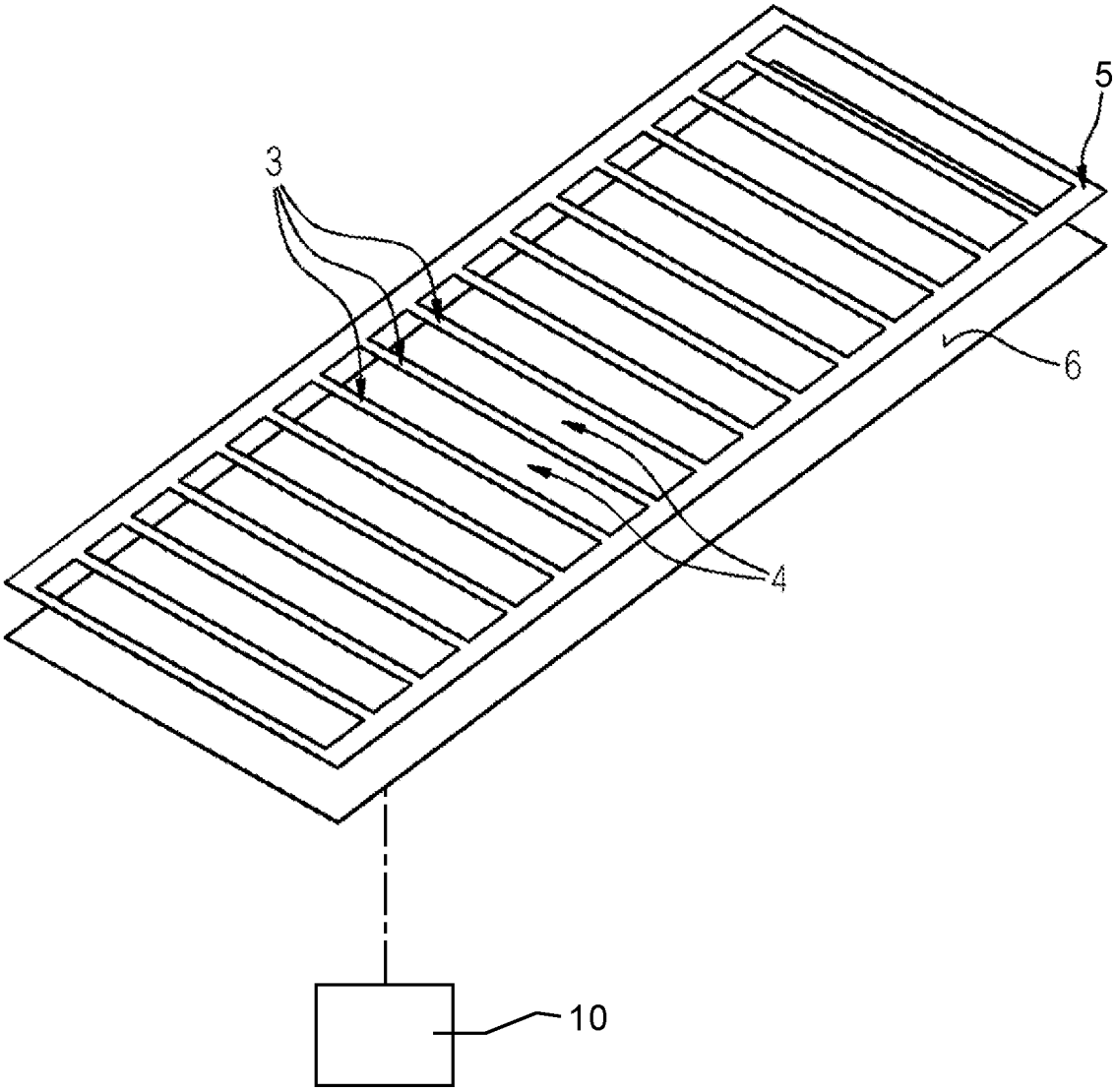
FIG. 4 shows, schematically, a step platform of a step device according to the invention.

FIG. 4 shows, schematically in a three-dimensional illustration, an extendable step platform according to the invention for a rail vehicle, which can be extended out of an associated housing and is equipped with a step contact mat divided up into a plurality of step contact segments 3 which, when subjected to pressure, generate signals which are input into a regulating unit 10. Here, the step contact mat also comprises two electrically conductive contact areas lying one above another. Here, the lower contact area 6 is formed over the entire area. The upper contact area 5, on the other hand, has an interrupted grid-shaped structure.

Non-sensitive regions 4 are arranged between strip-shaped step contact segments 3 that are arranged beside one another and are oriented parallel to an extension and retraction direction of the step platform 1 from and into the associated housing. If, then, smaller foreign bodies such as scatter grit are located on the non-sensitive regions, even when these are clamped in between the step platform and the associated housing as the step platform is retracted into the housing, no electrical contact is produced between the contact areas 5 and 6, and thus no signal is generated and transmitted to the regulating unit.

In order likewise not to generate and to transmit a signal or to be able to ignore this signal if the scatter grit is resting on one of the step contact segments 3, the distances between the step contact segments are dimensioned in such a way that an object with a predefined minimum contact area with the step platform 1 applies pressure to at least two directly adjacent step contact segments 3, and the step platform 1 is designed in such a way that a signal representing a relevant object is generated and transmitted to the regulating unit only when the object on the step platform 1 subjects two directly adjacent step contact segments 3 to pressure or the regulating unit is designed in such a way that a relevant object is detected only when signals are transmitted from two directly adjacent step contact segments 3.

Figure 5:
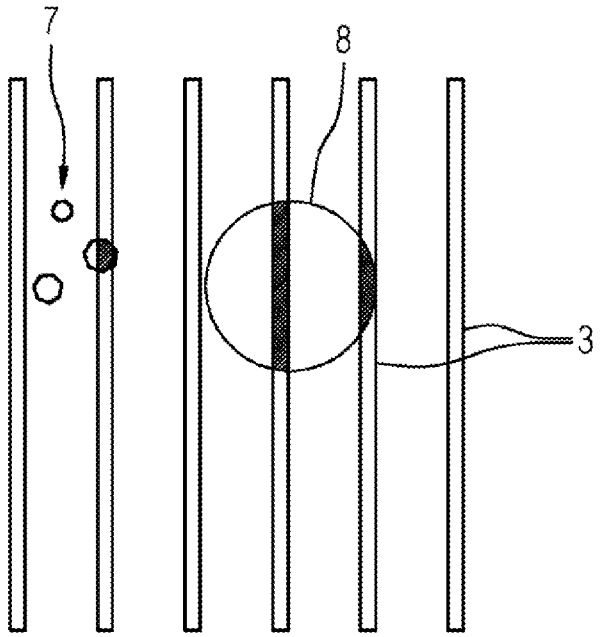
FIG. 5 shows, schematically, the step platform from FIG. 4 with an object to be detected as relevant for the control of the retraction and extension movement.

The distance of two adjacent step contact segments 3 and therefore the width of the non-sensitive regions 4 between them is dimensioned in such a way that each object having a minimum contact area 8 relative to the step platform with a diameter of 40 mm always touches at least two directly adjacent step contact segments 3 and can apply pressure, as sketched in FIG. 5. Smaller objects, such as scatter grit 7, can thus remain unconsidered.

Figure 6:
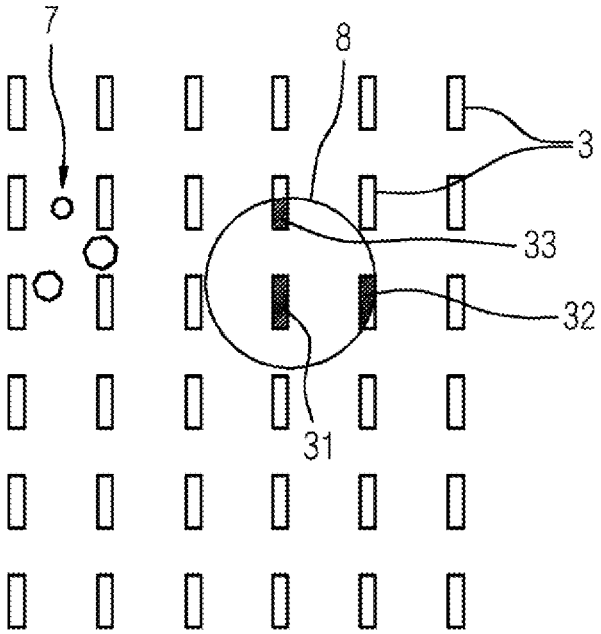
FIG. 6 shows a further embodiment of a step platform according to the invention.

A further embodiment is sketched in FIG. 6. The step contact segments 3 are designed as flat geometric figures, here as small rectangles. In addition to the distance perpendicular to the retraction and extension movement of the step platform 1, each step contact segment 3 additionally is at a distance to its immediate neighbors in the direction of the retraction and extension movement of the step platform 1. It is also possible to speak of interrupted, strip-shaped step contact segments 3. A signal is generated or the signals from the step contact segments are detected as relevant by the regulating unit only when a first step contact segment 31 and its immediate neighbors 32 and 33 are subjected to pressure in the direction and transversely to the direction of the retraction and extension movement of the step platform 1.

The invention claimed is:

1. A step device for a rail vehicle, the step device comprising:

a step platform;

a housing from which said step platform can be extended and retracted again; and a regulating unit for controlling an extension and retraction movement of said step platform;

said step platform including a plurality of step contact segments generating signals transmitted to said regulating unit upon said step contact segments being subjected to pressure;

said step contact segments being strip-shaped, being disposed beside one another and being parallel to a direction of said extension and retraction movement of said step platform;

said step contact segments being disposed on said step platform at predefined distances greater than zero relative to one another, causing an object having a predefined minimum contact area with said step platform to subject at least a directly adjacent two of said step contact segments to pressure; and said step platform configured to generate and transmit a signal representing a relevant object to said regulating unit only when the object on said step platform subjects said two directly adjacent step contact segments to pressure, or said regulating unit configured to detect a relevant object only upon signals being transmitted from said two directly adjacent said step contact segments.

2. The step device according to claim 1, wherein said step contact segments are configured with geometric shapes and are distributed over said step platform.

3. The step device according to claim 1, wherein said step contact segments are disposed at equal distances from one another.

4. The step device according to claim 1, which further comprises non-sensitive regions disposed between said step contact segments, said step contact segments being smaller than said non-sensitive regions.

5. The step device according to claim 1, wherein said step contact segments each have a width b predefined as a function of a distance u from a directly adjacent step contact segment, wherein $b=u*c$, and $c<0.5$.

6. The step device according to claim 5, wherein said predefined distance u between two directly adjacent step contact segments is at most 20 mm.

7. The step device according to claim 1, wherein said step contact segments are configured to only generate signals transmitted to said regulating unit upon said step contact segments being subjected to a predefined minimum pressure.

8. The step device according to claim 1, wherein:

said step contact segments are disposed at a distance from one another in a direction of said retraction and extension movement of said step platform and transversely to said direction of said retraction and extension movement of said step platform;

an object having a predefined minimum contact area with said step platform applies pressure to a first one of said step contact segments, to at least a directly adjacent second one of said step contact segments disposed at a distance from said first step contact segment transversely relative to said direction of said retraction and extension movement of said step platform, and to at least a directly adjacent third one of said step contact segments disposed at a distance from said second step contact segment in said direction of said retraction and extension movement of said step platform; and said step platform is configured to generate and transmit a signal representing a relevant object to said regulating unit only when the object on said step platform applies pressure to said first step contact segment and to said second step contact segment and to said third step contact segment, or said regulating unit is configured to detect a relevant object only upon signals being transmitted from said first step contact segment and from said second step contact segment and from said third step contact segment.

9. A vehicle, comprising at least one step device according to claim 1.

* * * * *